US006173520B1

(12) United States Patent
Bucciarelli et al.

(10) Patent No.: US 6,173,520 B1
(45) Date of Patent: Jan. 16, 2001

(54) CARTRIDGE CASE CATCHER

(76) Inventors: Brian Bucciarelli, 24617 S. Valley Dr., Channahon, IL (US) 60410; Brad Bucciarelli, 1028 Eunice Ave., Joliet, IL (US) 60433

( * ) Notice: Under 35 U.S.C. 154(b), the term of this patent shall be extended for 0 days.

(21) Appl. No.: 09/305,965

(22) Filed: May 6, 1999

Related U.S. Application Data

(60) Provisional application No. 60/084,701, filed on May 8, 1998.

(51) Int. Cl.[7] ..... F41A 15/00
(52) U.S. Cl. ..... 42/98
(58) Field of Search ..... 42/98; 89/33.4

(56) References Cited

U.S. PATENT DOCUMENTS 663,262 * 12/1900 Dieterich ..... 42/98
4,028,834 6/1977 Dobson ..... 42/98
4,110,927 * 9/1978 Morris ..... 42/98
4,334,375 6/1982 Olson ..... 42/98
4,715,141 12/1987 Kohnke ..... 42/98
4,903,426 2/1990 Bammate ..... 42/98
5,138,787 8/1992 Riddle et al. ..... 42/98
5,285,593 2/1994 Bammate ..... 42/98
5,398,439 3/1995 Harless ..... 42/98

* cited by examiner

*Primary Examiner*—Michael J. Carone
*Assistant Examiner*—Elizabeth Shaw

(57) ABSTRACT

A device for catching and holding spent cartridges ejected from a conventional AR-15, M16, AR-10, or similar type rifle. The device consists of a steel frame with a cloth bag and two mounting pins that removably attach to a mount connected to the rifle. This positions said bag adjacent to the rifle's ejection port to catch spent cartridges during firing of the weapon.

2 Claims, 2 Drawing Sheets

CARTRIDGE CASE CATCHER

This application claims the benefit of Provisional Patent Application Ser. No. 60/084,701, filed May 8, 1998.

BACKGROUND OF THE INVENTION

The present invention relates to a cartridge collection device and more particularly a cartridge collection device comprising a removable container for catching and holding spent cartridge cases ejected from a rifle, especially automatic and semi-automatic firearms.

Semi-automatic and automatic firearms eject empty cartridge cases after firing. These metal cases are often lost or damaged as they land on the ground. Picking up scattered, dirty cases is always a difficult task. Since cartridge cases comprise the majority of the cost of ammunition and can be used for reloading numerous times, it is desirable to collect all spent cartridge cases. There also exists a danger of an ejected cartridge case striking another shooter and causing him to accidentally discharge his weapon. Such representative firearms are the AR-15, M16, AR-10 and similar type rifles.

Originally, devices for catching spent cartridges were bags or sacks supported on the ground placed in the direction of cartridge ejection. This design only works for firearms being shot in one direction or by individual shooters that it is set up for. If the firearm is turned or repositioned or if another shooter of a different height is using the device without repositioning the bag, the spent cartridges will not be caught. This problem was resolved by having the case catcher attached to the firearm. The devices, described in U.S. Pat. No. 5,285,593, U.S. Pat. No. 4,028,834, and U.S. Pat. No. 5,138,787 have the feature in common that they cannot be used for conventional flat-top type receivers. U.S. Pat. No. 5,138,787 cannot be used with a conventional scope mount and scope. All three patents have a plastic main portion that does not offer the structural strength of a metal type frame. The patents cited have to be taken off, rotated or partially disassembled to empty its contents.

OBJECTS AND ADVANTAGES OF THE INVENTION

Accordingly, several objects and advantages of my invention are:

(a) To provide a case catcher that can be used with or without a conventional scope mount and scope;

(b) To provide a case catcher that can be used on conventional handled receivers as well as conventional flat-top type receivers;

(c) To allow easy emptying of case catcher by the use of hook and loop closure fastened at the bottom of the bag without the hassle of disconnecting from firearm;

(d) To provide a one handed quick disconnect of case catcher for easy on/off use, transportation, or storage;

(e) To provide a case catcher bag with a sloping cloth back portion to absorb impact of ejected cases and eliminate cases bouncing back into firearm;

(f) To provide a lightweight, durable, and attractive firearm accessory;

(g) To provide a rigid mounting system and metal frame that will not flex under the weight of cartridge cases;

(h) To provide a case catcher that can be made in a variety of colored fabric;

(i) To provide a mounting system that locks case catcher securely in place with two ball detents to prevent falling off under the recoil of a firearm;

(j) To provide a case catcher bag that has a sloping back portion made of cloth to direct ejected cartridge cases into the lower portion of bag;

(k) To provide a case catcher bag that slopes away from the shooters hand to provide clearance for trigger and magazine release;

Further objects and advantages of the invention will become apparent from a consideration of the drawings and ensuing description.

BRIEF DESCRIPTION OF THE DRAWING FIGURES

REFERENCE NUMERALS IN DRAWINGS

10 Mount
12 Mounting Nut
14 Mounting Bolt
16 Bag
18 Frame
20 Hook and Loop Closure
21 Trim
22 Ball Detent with Spring
24 Taper
26 Mounting Pins
28 Mounting Holes
30 Scope Ring Mounting Holes
32 Handle
34 Flat-top Receiver
36 Trigger
38 Sloping Back
40 Sloping Front

SUMMARY OF THE INVENTION

Accordingly, it is an object of the present invention to provide a device for catching and holding spent cartridges ejected from a rifle to prevent lost or damaged cartridges and prevent striking other shooters.

DESCRIPTION OF THE PREFERRED EMBODIMENT

Figure 1:
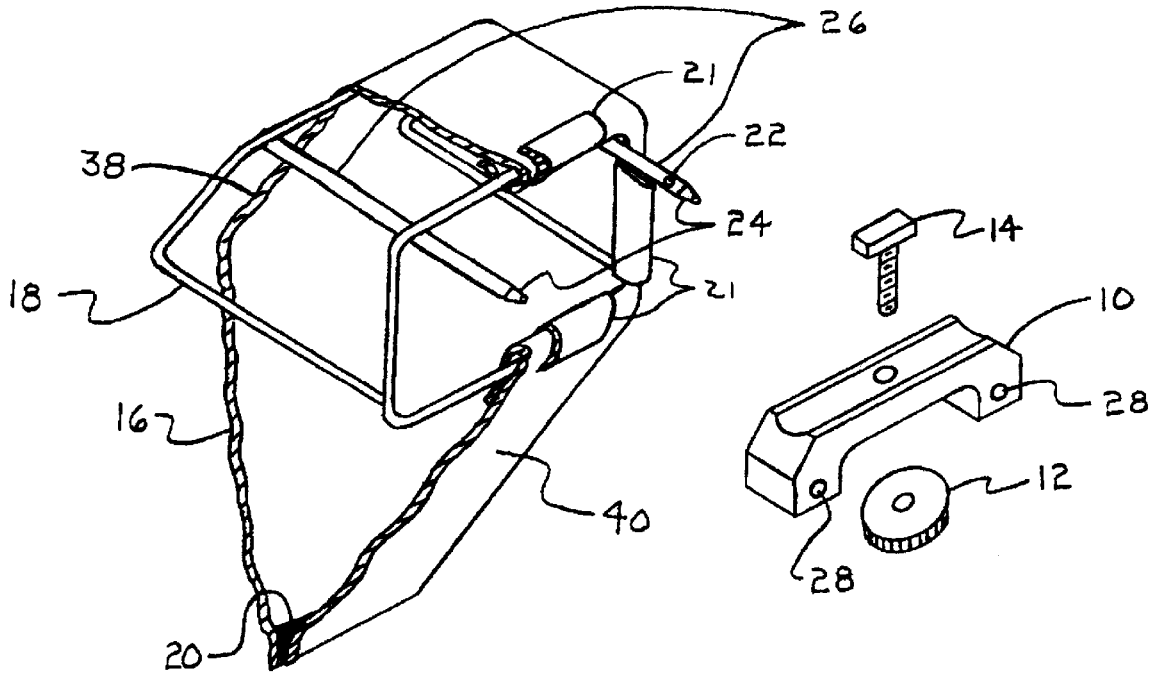
FIG. 1 shows an isometric view of cartridge case catcher and mount.
Figure 2:
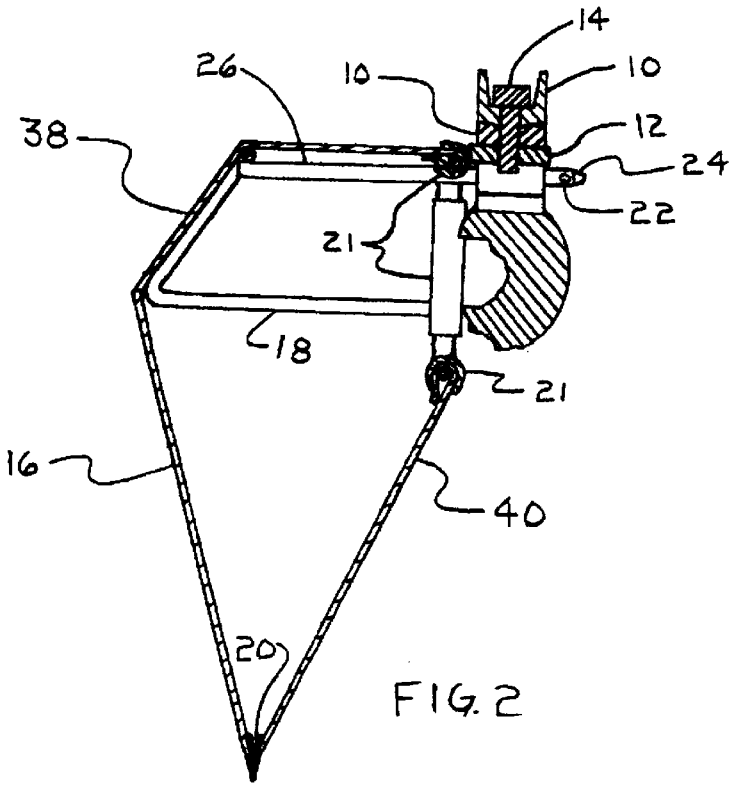
FIG. 2 shows a cross sectional view of cartridge case catcher attached to an AR-15, M16, AR-10 or similar type firearm with conventional handle.
Figure 3:
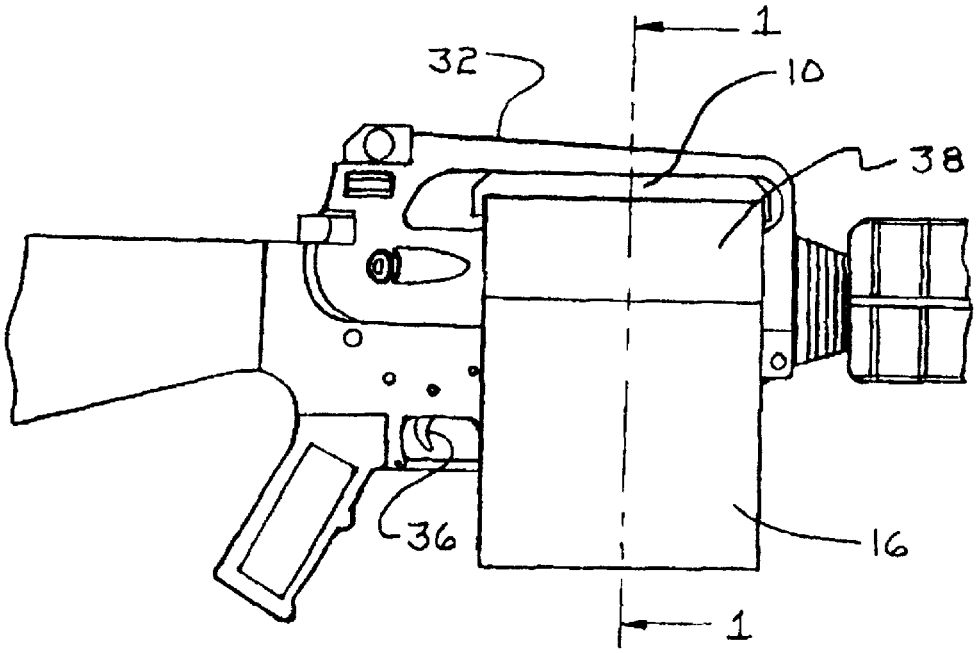
FIG. 3 shows the cartridge case catcher with mount attached to an AR-15, M16, AR-10 or similar type firearm with conventional handle.

In its first embodiment, shown in FIGS. 1,2,3, the cartridge case catcher bag 16 is composed of multiple pieces of cloth sewn together with a sloping back 38 and a sloping front 40. The cloth bag 16 has an opening in the bottom that is fastened together with hook and loop closure 20. There are four pieces of plastic trim 21 that holds the fabric securely to the frame 18. Frame 18 is a metal fabrication that is welded, brazed, or otherwise permanently fastened together. The front part of the frame 18 is made up of two mounting pins 26 with a portion of their tip in the shape of a taper 24.

Near taper 24 is a ball detent with spring 22 that allow mounting pins 26 to securely lock into mount 10. Mount 10 is made of a hard plastic type material with chamfered corners, a grooved top, and a hole to accept mounting bolt 14. Mount 10 also has two mounting holes 28 to accept the mounting pins 26 of frame 18. Mounting bolt 14 along with mounting nut 12 securely fasten mount 10 to handle 32 of firearm.

Figure 4:
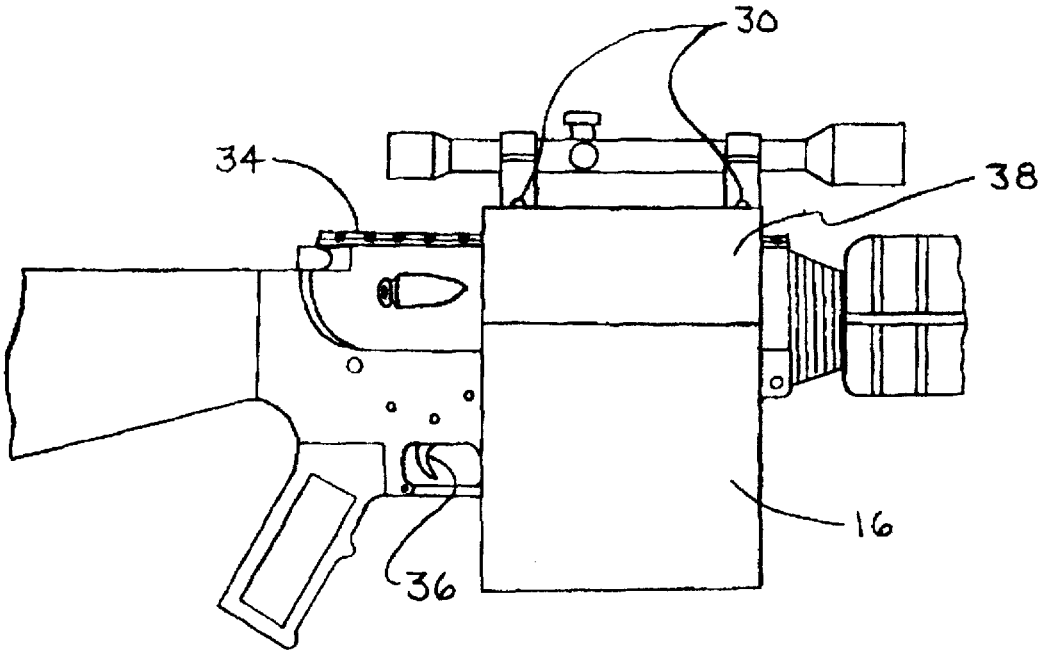
FIG. 4 shows cartridge case catcher attached to the conventional scope rings of an AR-15, M16, AR-10 or similar type firearm with a conventional flat-top receiver.

The second embodiment, shown in FIG. 4, mounting pins 26 of case catcher is inserted into scope ring mounting holes 30 in the firearm's scope rings for the attachment to conventional flat-top receiver 34.

OPERATION-FIGS. 1,2,3,4

The manner in using cartridge case catcher in FIGS. 2,3 is to put mounting bolt 14 through hole in firearm's handle 32, through mount 10, and into mounting nut 12. Tighten mounting nut 12 to secure mount 10 to handle 32. Insert mounting pins 26 of frame 18 into mounting holes 28 and push bag 16 until ball detent with spring 22 clears the back side of mount 10 and securely locks case catcher to mount 10. Upon firing, empty cases will eject into sloping back 38 and fall to bottom of bag 16. Sloping front 40 prevents interference of bag 16 with trigger 36. When bag 16 is full, pull on both sides of hook and loop closure 20 to open bottom of bag 16 and allow empty cases to fall out. Press both sides of hook and loop closure 20 to reseal bottom of bag 16.

Another variation of FIGS. 1,2,3 is to use case catcher with a conventional scope mount. A typical AR-15, M16, AR-10 or similar type firearm's scope mount has a bolt attached to it. Insert the scope mount bolt through handle 32 of firearm, through mount 10 and into mounting nut 12. The operation of case catcher is identical to that without a scope mount as explained above in Operation-FIGS. 1,2,3,4 paragraph 1.

FIG. 4 shows another variation of case catcher being used without mounting bolt 14, mounting nut 12, or mount 10. Mounting pins 26 of frame 18 are inserted and pushed through scope ring mounting holes 30 to securely fasten case catcher to an AR-15, M16, AR-10, or similar type firearm with a conventional flat-top receiver 34. The operation of case catcher is the same as described previously. To remove case catcher for storage or transportation, pull on bag 16 to release ball detent with spring 22 and disconnect case catcher from mount 10 or scope ring mounting holes 30.

CONCLUSION, RAMIFICATIONS, AND SCOPE

Accordingly, the reader will see that the present invention contains many novel features. The cartridge case catcher can be used with or without a conventional scope mount and scope. It can also be used on conventional handled receivers as well as conventional flat-top type receivers. Furthermore, the cartridge case catcher has the additional advantages in that

- It provides a case catcher that can be easily emptied using hook and loop closure at bottom of bag;
- It provides a back portion made of cloth to absorb impact and eliminate possibility of spent cartridge bouncing back into firearm;
- It provides a rigid frame and mounting system that will not deform under the weight of many cartridge cases;
- It provides a case catcher that can be made in a variety of colors;
- It provides a rigid mounting system that locks case catcher securely in place with two ball detents to prevent falling off under the recoil of a firearm;
- It allows the case catcher bag to be quickly disconnected with one hand for easy on/off use, transportation, or storage;
- It provides a sloping back to direct spent cases into the lower portion of bag.

Although the description above contains many specificities, these should not be construed as limiting the scope of the invention but merely providing illustrations of some of the presently preferred embodiments of this invention. For example, the frame can be made from a casting, forging, or even an injected molded polymer. The shape of the bag can have other shapes, such as circular, oval, trapezoidal, triangular, etc. The bottom of the bag can be fastened with a zipper, buttons or a clamp.

Thus the scope of the invention should be determined by the appended claims and their legal equivalents, rather than by the examples given.

What is claimed is:

1. A device for catching and holding spent cartridge cases ejected from a rifle comprising:

a rigid frame having a plurality of mounting pins for securing said device to a mount on a handled receiver and to scope rings on a flat-top receiver;

a bag attached to said frame with a sloping back mounted adjacent to ejection port of said rifle;

said mount made of high strength plastic with a groove on top and two holes for means of attaching said frame.

2. The device of claim 1, wherein said bag is comprised of multiple pieces of cloth sewn together and permanently fastened to said frame.

* * * * *